US005535458A

United States Patent [19]

Siverly

[11] Patent Number: 5,535,458

[45] Date of Patent: Jul. 16, 1996

[54] BATHING SEAT

[76] Inventor: Terry L. Siverly, 5674 General Diaz, New Orleans, La. 70124

[21] Appl. No.: 427,899

[22] Filed: Apr. 26, 1995

[51] Int. Cl.[6] ..... A47K 3/12

[52] U.S. Cl. ..... 4/579.000; 4/573.1; 4/575.1

[58] Field of Search ..... 4/571.1, 573.1, 4/575.1, 578.1, 579, 581, 582, 583

[56] References Cited

U.S. PATENT DOCUMENTS

| | | | |
|---|---|---|---|
| D. 335,036 | 8/1993 | Simmons | 4/579 X |
| 1,759,348 | 5/1930 | Fishman | 4/575.1 |
| 2,167,178 | 7/1939 | Kohlstadt | 4/575.1 |
| 2,593,319 | 4/1952 | Levitin et al. | 4/573.1 X |
| 2,713,174 | 7/1955 | Merlin et al. | 4/575.1 |
| 3,078,474 | 2/1963 | Chaitlen | 4/575.1 |
| 3,583,001 | 6/1971 | Steinhoff | 4/575.1 |
| 4,037,591 | 7/1977 | Sarno | 128/33 |
| 4,891,848 | 1/1990 | Carter | 4/571.1 |
| 5,014,373 | 5/1991 | Dobine | 4/575.1 |
| 5,067,182 | 11/1991 | Koelsch | 4/498 |
| 5,140,713 | 8/1992 | Pesterfield | 4/575.1 |

FOREIGN PATENT DOCUMENTS

| | | | |
|---|---|---|---|
| 0240882 | 11/1911 | Germany | 4/573.1 |
| 0367143 | 2/1932 | United Kingdom | 4/575.1 |
| 0421176 | 12/1934 | United Kingdom | 4/581 |

*Primary Examiner*—Robert M. Fetsuga
*Attorney, Agent, or Firm*—Joseph N. Breaux

[57] ABSTRACT

A bathing seat including a seat section, pivotally linked to a back support section using a two-pivot hinge. The seat section has a seating member having a contoured surface that supports the legs and buttocks of a user during use. A portion of the seat section utilized to support the thighs of a user is elevated with respect to the portion utilized to support the buttocks urging the user back into the seat without having to expend the effort to remain seated. The back support section has a back support member that includes a neck support and a lumbar-type support.

15 Claims, 6 Drawing Sheets

BATHING SEAT

TECHNICAL FIELD

The present invention relates to devices to aid a person in bathing and more particularly to seating devices securable within a bathing vessel that may be utilized while bathing.

BACKGROUND ART

The interior surfaces of bathing vessels, such as bathtubs, can become slippery and dangerous under the wet and soapy conditions inherent in the bathing process. These slippery conditions are particularly dangerous for weak and infirm individuals whose reflexes may be too impaired to maintain or regain their balance when a slip occurs.

In an effort to prevent slip related injuries, a bathing seat may be installed within the bath tub to provide a convenient, comfortable support that minimizes the risk of slipping. Various bathing seats have been devised that may be secured to the interior surface of the bath tub. However, these devices are often uncomfortable, hard to store when not in use, and provide little or no support for maintaining the bather in a seated position. It would be a benefit therefore to have a seating device that allowed individuals to seat themselves while bathing which provided neck and back support while providing a cushioned seating surface that tended to support the individual in a seated position.

GENERAL SUMMARY DISCUSSION OF INVENTION

It is thus an object of the invention to provide a bathing seat that is securable to the horizontal and substantially vertical interior surfaces of a bathing vessel.

It is a further object of the invention to provide a bathing seat that may be folded for storage with the cushioned surfaces of the seat oriented outwardly.

It is a still further object of the invention to provide a bathing seat that includes a cushioned seating surface that tends to support the individual in a seated position.

Accordingly, a bathing seat including a seat section, a back support section, and a two-pivot hinge linking the seat section and back support section is provided. The seat section has a seating member having a contoured surface that supports the legs and buttocks of a user during use. A portion of the seat section utilized to support the thighs of a user is elevated with respect to the portion utilized to support the buttocks. Because the thighs are elevated with respect to the buttocks, the user is urged back into the seat without having to expend the effort to remain seated. This allows the bather to relax while bathing and helps ensure that weak and infirm bathers remain seated while bathing.

The back support section has a back support member that includes a neck support and a lumbar-type support. The neck support allows the user to rest with his head back while soaking. The lumbar-type support provides support to the small of the back allowing for more restful reclining.

The seat section and the back support section are pivotally attached to each other by two, two-pivot hinges. The use of two-pivot hinges allows the bathing seat to be folded into a storage configuration with the backs of the seat section and the back support section substantially parallel to each other.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
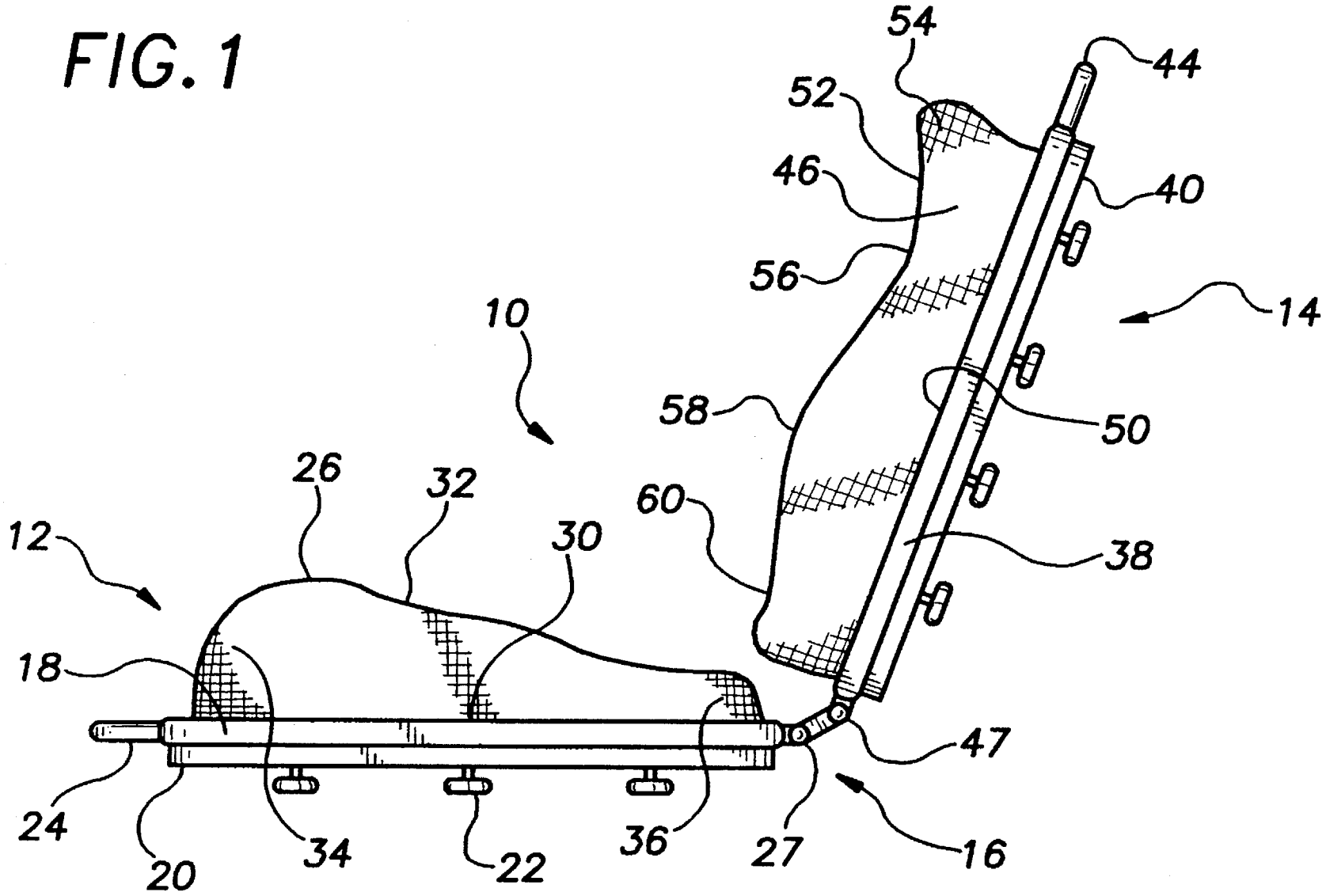
FIG. 1 is a schematic, side view of an exemplary embodiment of the bathing seat of the present invention unfolded in the utilization configuration.

FIG. 1 is a side schematic view of an exemplary embodiment of the bathing seat of the present invention, generally designated by the numeral 10, in the utilization configuration. Bathing seat 10 includes a seat section, generally designated by the numeral 12, and a back support section, generally designated by the numeral 14. Seat section 12 and back support section 14 are pivotally connected by a two-pivot hinge, generally designated by the numeral 16, to allow seat section 12 to pivot at two points with respect to back support section 14.

Figure 2:
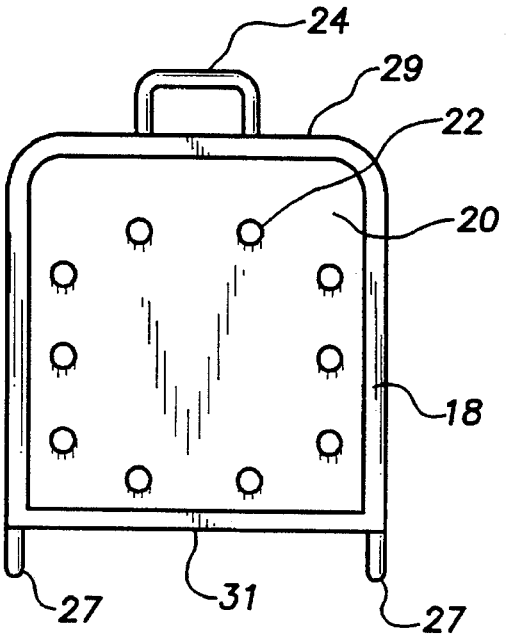
FIG. 2 is a bottom view of the seat section of the bathing seat illustrated in FIG. 1.

Seat section 12 includes a substantially planar, rigid support plate 18, an attachment pad 20, a handle 24, a seat cushion 26, and two hinge members 27 (one not shown). With reference to FIG. 2, support plate 18 is a twenty by twenty-four inch (20"×24") rectangular section of one-quarter inch (¼") thick plastic sheeting. Handle 24 is a conventional U-shaped plastic member secured to one of the twenty inch edges 29 of support plate 18. Hinge members 27 are spaced apart about seventeen inches and secured to support plate 18 along a side 31 that is opposite side 29.

Attachment pad 20 is constructed from an eighteen by twenty-two inch (18"×22") section of one-eighth inch (⅛") thick flexible rubber sheeting. Ten, one inch diameter, rubber suction cups 22 are attached to one side of attachment pad 20. Suction cups 22 are oriented away from attachment pad 20 to allow suction cups 22 to contact and secure seat section 12 to the bottom of a bath tub during use.

With Reference once again to FIG. 1, seat cushion 26 is constructed of waterproof, plastic foam, molded into a shape having one substantially planar side 30, and one contoured side 32. Seat cushion 26 is about four inches thick at one end 34 and tapers to a thickness of about one and one-half inches at a second end 36. Side 30 of seat cushion 26 is adhesively secured to support plate 18 with end 34 positioned toward handle 24.

Figure 3:
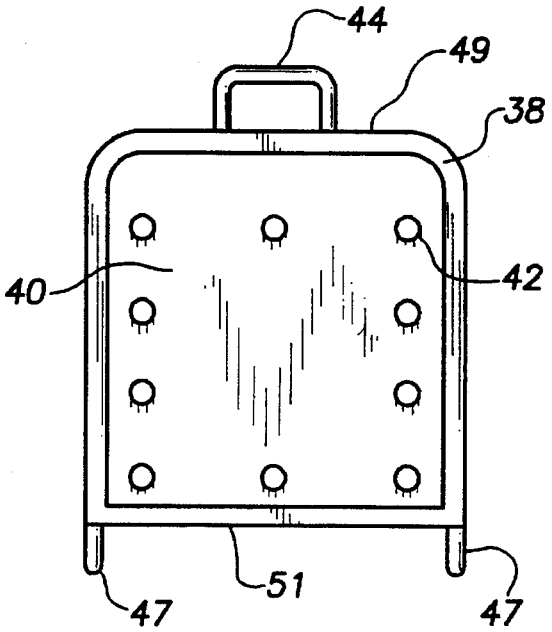
FIG. 3 is back view of the back support section of the bathing seat illustrated in FIG. 1.

Back support section 14 includes a substantially planar, rigid second support plate 38, a second attachment pad 40, a handle 44, a back cushion 46, and two hinge members 47 (only one shown). With reference to FIG. 3, second support plate 38 is a twenty by twenty-four inch (20"×24") rectangular section of one-quarter inch (¼") thick plastic sheeting. Handle 44 is a conventional U-shaped plastic member secured to one of the twenty inch edges 49 of second support plate 38. Hinge members 47 are spaced apart about seventeen inches and secured to second support plate 38 along a side 51 that is opposite side 49.

Attachment pad 40 is constructed from an eighteen by twenty-two inch (18"×22") section of one-eighth inch (⅛") thick flexible rubber sheeting. Ten, one inch diameter, rubber suction cups 42 are attached to one side of attachment pad 40. Suction cups 42 are oriented away from attachment pad 40 to allow suction cups 42 to contact and secure back support section 14 to the side wall of a bath tub during use.

With Reference once again to FIG. 1, back cushion 46 is constructed of waterproof, plastic foam, molded into a shape having one substantially planar side 50, and one contoured side 52. Back cushion 46 includes a neck rest portion 54 having a thickness of about three and one-half (3½") inches; a first low portion 56 having a thickness of about one and one-half (1½") inches; a lumbar support portion 58 having a thickness of about two and one-half (2½") inches; and a terminal portion 60 having a thickness of about one and one-half (1½") inches. Side 50 of back cushion 46 is adhesively secured to support plate 38 with neck support portion 54 positioned toward handle 44.

Figure 4:
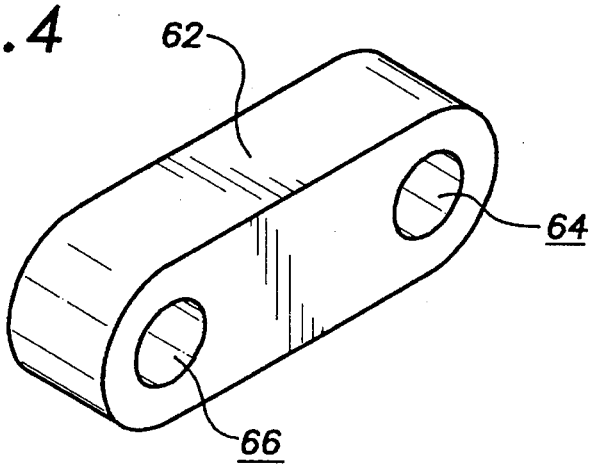
FIG. 4 is an isometric view of one of the connecting links used to form the two-pivot hinge utilized to connect the seat section to the back support section.
Figure 5:
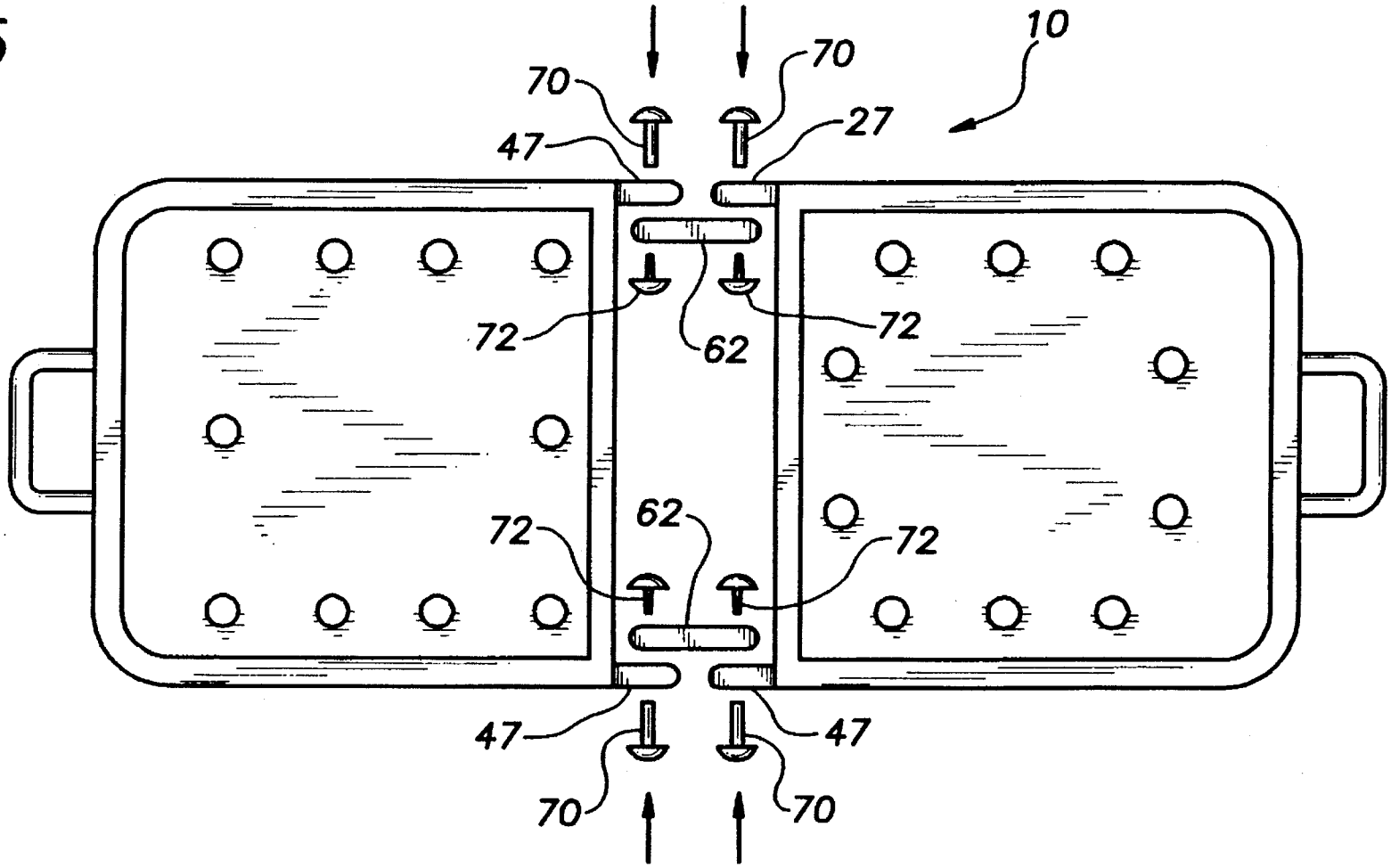
FIG. 5 is a backside view of the bathing seat of FIG. 1 showing assembly of the two-pivot hinges.
Figure 6:
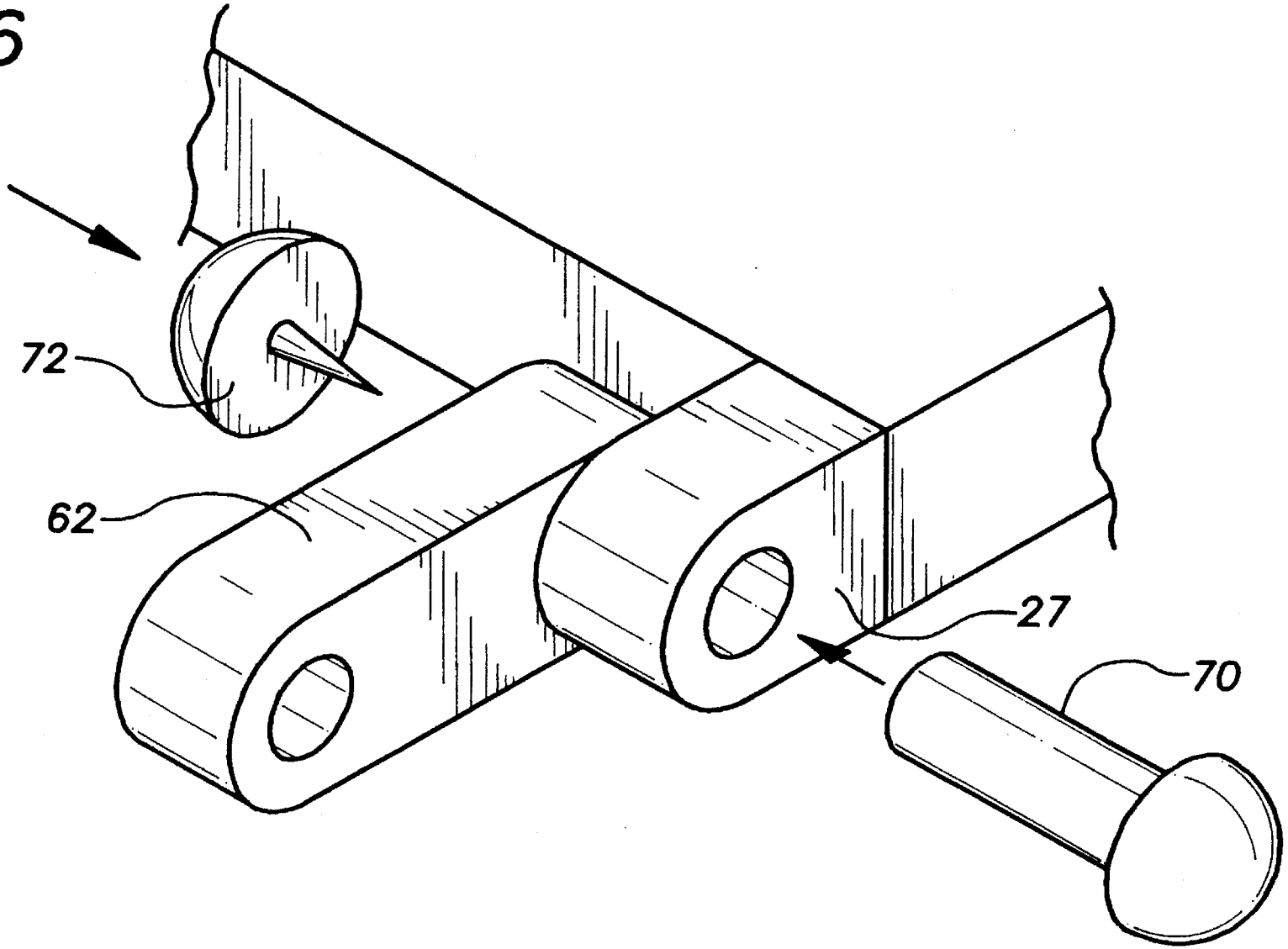
FIG. 6 is a detail, isometric view of one link between a hinge member and a connecting link.

FIG. 4 shows a connecting link 62 having two cylindrical apertures 64,66. Bathing seat 10 includes two connecting links 62. As shown in FIG. 5, one connecting link 62 is positioned between a pair of hinge members 27,47 and pivot pins 70 installed through apertures 64,66 and locked in place with a cap pin 72. FIG. 6 is a detail view illustrating the interconnection between a connecting link 62, a hinge member 27,47, a pivot pin 70, and a cap pin 72.

Figure 7:
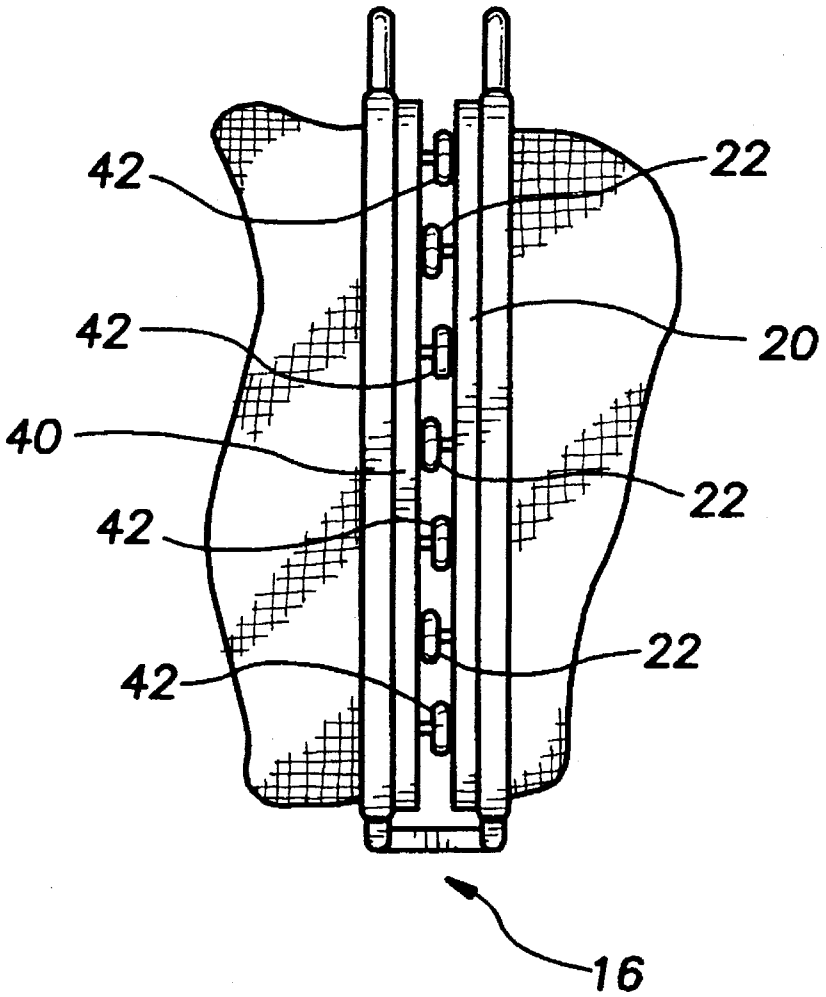
FIG. 7 is a side schematic view of the exemplary embodiment of the bathing seat illustrated in FIG. 1 folded into the storage configuration.
Figure 8:
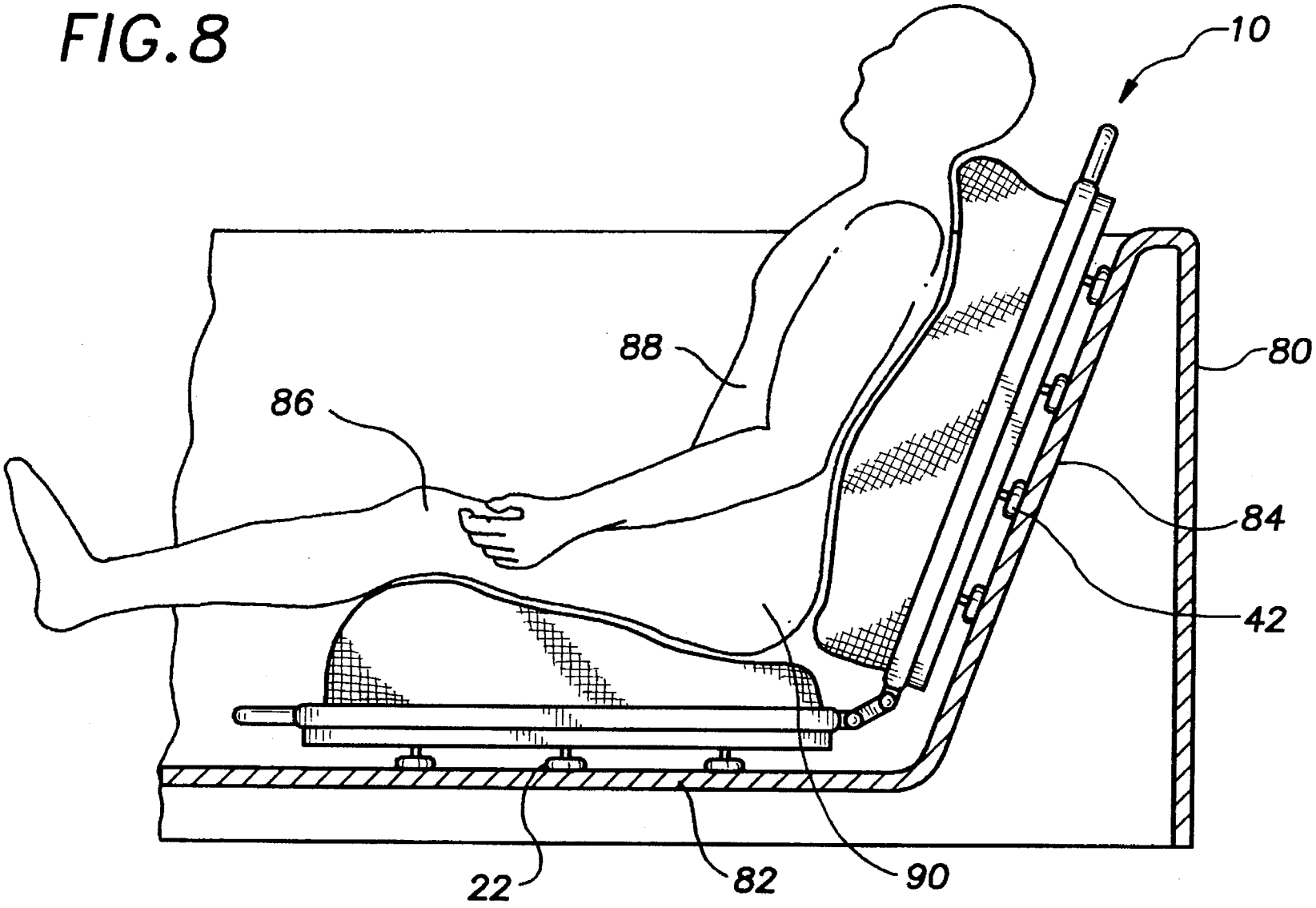
FIG. 8 is a schematic side view of the bathing seat of FIG. 1 in use in a representative bath tub.

The two-pivot hinge 16, thus created, allows bath seat 10 to be folded into the storage configuration shown in FIG. 7. As shown in the figure, suction cups 22 and suction cups 42 are arranged on their respective attachment pads 20,40 to allow suction cups 22 to contact and form a seal against attachment pad 40 and suction cups 42 to contact and form a seal against attachment pad 20 when folded into the storage configuration shown. The suction formed between suction cups 22 and attachment pad 38 and suction cups 42 and attachment pad 18 retains bathing seat 10 in the storage configuration during storage.

FIG. 7 shows bathing seat 10 in use in a representative bath tub 80. As shown, suction cups 22 adhere to the bottom surface 82 of bath tub 80 and suction cups 42 adhere to the side wall 84 of bath tub 80. Also illustrated is the raised position that the knees 86 assume with respect to the buttocks 90 of a person 88 seated in bathing seat 10. Raising the knees as shown keeps the person 88 comfortably in the seated position.

Use of bathing seat 10 is now described with general reference to FIGS. 1–8. To install bathing seat 10 in a bath tub, seat section 12 and back support section 14 are brought together, two-pivot hinge 16 is placed at the intersection of the sidewall and bottom surfaces at the end of the bath tub, seat section 12 is rotated down until suction cups 22 contact the bottom surface of the bath tub; and back support section 14 rotated away from seat section 12 until suction cuds 42 contact the sidewall of the bath tub. Bathing seat 10 is now ready for use. Storing bathing seat 10 is accomplished by simply reversing the installation process.

it can be seen from the preceding description that a bathing seat that is securable to the horizontal and substantially vertical interior surfaces of a bathing vessel; that may be folded for storage with the cushioned surfaces of the seat oriented outwardly; and that includes a cushioned seating surface that tends to support the individual in a seated position has been provided.

It is noted that the embodiment of the bathing seat described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A bathing seat comprising:

a seat section having a first support plate having a first and second substantially planar surface; a seating member having a contoured surface and a first securing surface, said first securing surface being attached to said first substantially planar surface; a first and second hinge member, each having a pivot pin receiving aperture, said first and second hinge members being spaced apart and secured to a first edge of said first support plate;

a back support section having a second support plate having a third and fourth substantially planar surface; a back support member having a second contoured surface and a second securing surface, said second securing surface being attached to said third substantially planar surface; a third and fourth hinge member, each having a pivot pin receiving aperture, said third and fourth hinge members being spaced apart and secured to a second edge of said second support plate;

a first and second connecting link, each connecting link having a first and second link aperture formed therethrough, said link apertures having longitudinal axes oriented substantially in parallel with one another;

first, second, third, and fourth pivot pins having a length sufficient to simultaneously pass through a said pivot pin aperture and a said link aperture, and a diameter sufficient to slidingly fit within a said pivot pin aperture and a said link aperture; and first, second, third, and fourth cap pins each securable to an end of said first, second, third, and fourth pivot pins, respectively, in a manner such that said first, second, third, and fourth pivot pins are retained within a said pivot pin aperture and a said link aperture.

2. The bathing seat of claim 1, wherein:

said seating member has a first portion thereof where said contoured surface is spaced a first predetermined distance, between two and one-half and four inches, from said securing surface, and a second portion thereof where said contoured surface is spaced a second predetermined distance from said securing surface, at least one and one-half inches less than said first predetermined distance.

3. The bathing seat of claim 2, wherein:

said second portion of said seat member is positioned between said first portion and said first and second hinge members.

4. The bathing seat of claim 1 wherein:

said seat section further includes a first attachment pad having a surface secured to said second substantially planar surface of said first support plate and a first cup surface having a plurality of first suction cups protruding therefrom.

5. The bathing seat of claim 4, wherein:

said seating member has a first portion thereof where said contoured surface is spaced a first predetermined distance, between two and one-half and four inches, from said first securing surface, and a second portion thereof where said contoured surface is spaced a second predetermined distance from said securing surface, at least one and one-half inches less than said first predetermined distance.

6. The bathing seat of claim 5, wherein:

said second portion of said seat member is positioned between said first portion and said first and second hinge members.

7. The bathing seat of claim 5 wherein:

said back support section further includes a second attachment pad having a surface secured to said fourth substantially planar surface of said second support plate and a second cup surface having a plurality of second suction cups protruding therefrom.

8. The bathing seat of claim 7 wherein:

said seat section further includes a first attachment pad having a surface secured to said second substantially planar surface of said first support plate and a first cup surface having a plurality of first suction cups protruding therefrom.

9. The bathing seat of claim 8 wherein:

said first suction cups are arranged in a first predetermined pattern; and said second suction cups are arranged in a second predetermined pattern;

said first and second predetermined patterns being selected in a manner to allow said first suction cups to contact said second cup surface when said seat section and said back support section are folded in a first predetermined configuration.

10. The bathing seat of claim 1 wherein:

said back support section further includes a second attachment pad having a surface secured to said fourth substantially planar surface of said second support plate and a second cup surface having a plurality of second suction cups protruding therefrom.

11. The bathing seat of claim 10 wherein:

said seat section further includes a first attachment pad having a surface secured to said second substantially planar surface of said first support plate and a first cup surface having a plurality of first suction cups protruding therefrom.

12. The bathing seat of claim 11 wherein:

said first suction cups are arranged in a first predetermined pattern; and said second suction cups are arranged in a second predetermined pattern;

said first and second predetermined patterns being selected in a manner to allow said first suction cups to contact said second cup surface when said seat section and said back support section are folded in a first predetermined configuration.

13. The bathing seat of claim 1, wherein:

said second portion of said seat member is positioned between said first portion and said first and second hinge members.

14. A bathing seat comprising:

a seat section having a first support plate having a first and second substantially planar surface; a seating member having a contoured surface and a securing surface, said securing surface being attached to said first substantially planar surface; a first and second hinge member, each having a pivot pin receiving aperture, said first and second hinge members being spaced apart and secured to an edge of said first support plate;

a back support section having a second support plate having a third and fourth substantially planar surface; a back support member having a second contoured surface and a second securing surface, said second securing surface being attached to said third substantially planar surface; a third and fourth hinge member, each having a pivot pin receiving aperture, said third and fourth hinge members being spaced apart and secured to an edge of said second support plate;

a first and second connecting link, each connecting link having a first and second link aperture formed therethrough and having longitudinal axes oriented substantially in parallel with one another;

first, second, third, and fourth pivot pins having a length sufficient to simultaneously pass through a said pivot pin aperture and a said link aperture, and a diameter sufficient to slidingly fit within a said pivot pin aperture and a said link aperture; and first, second, third, and fourth cap pins each securable to an end of said first, second, third, and fourth pivot pins, respectively, in a manner such that said first, second, third, and fourth pivot pins are retained within a said pivot pin aperture and a said link aperture;

said seating member having a first portion thereof where said contoured surface is spaced a first predetermined distance, between two and one-half and four inches, from said securing surface, and a second portion thereof where said contoured surface is spaced a second predetermined distance from said securing surface, at least one and one-half inches less than said first predetermined distance; said second portion of said seat member being positioned between said first portion and said first and second hinge members; said back support section further including a second attachment pad having a surface secured to said fourth substantially planar surface of said second support plate and a second cup surface having a plurality of second suction cups protruding therefrom; said seat section including a first attachment pad having a surface secured to said second substantially planar surface of said first support plate and a first cup surface having a plurality of first suction cups protruding therefrom.

15. The bathing seat of claim 14 wherein:

said first suction cups are arranged in a first predetermined pattern; and said second suction cups are arranged in a second predetermined pattern;

said first and second predetermined patterns being selected in a manner to allow said first suction cups to contact said second cup surface when said seat section and said back support section are folded in a first predetermined configuration.

* * * * *